US005215049A

United States Patent [19]

Wolf

[11] Patent Number: 5,215,049

[45] Date of Patent: Jun. 1, 1993

[54] PORTABLE HANDHELD WORK APPARATUS

[75] Inventor: Günter Wolf, Oppenweiler, Fed. Rep. of Germany

[73] Assignee: Andreas Stihl, Waiblingen, Fed. Rep. of Germany

[21] Appl. No.: 902,597

[22] Filed: Jun. 22, 1992

[30] Foreign Application Priority Data

Jun. 21, 1991 [DE] Fed. Rep. of Germany ..... 4120876

[51] Int. Cl.[5] ..... F02M 1/10

[52] U.S. Cl. ..... 123/179.18; 123/179.16; 261/52; 261/65; 261/64.6

[58] Field of Search ..... 123/179.18, 179.16; 261/64.4, 52, 65, 64.6

[56] References Cited

U.S. PATENT DOCUMENTS

| | | | |
|---|---|---|---|
| 3,831,567 | 8/1974 | Freismuth et al. | 261/64.6 |
| 3,907,945 | 9/1975 | Kobayashi et al. | 261/52 |
| 4,079,708 | 3/1978 | Wieland et al. . | |
| 4,123,480 | 10/1978 | Johansson | 261/52 |
| 4,439,377 | 3/1984 | Nartowski | 261/52 |
| 4,500,478 | 2/1985 | Furukawa et al. | 261/52 |
| 4,672,929 | 6/1987 | Wissmann et al. | 123/179.18 |
| 4,773,362 | 9/1988 | Wissmann et al. | 261/52 |
| 5,018,492 | 5/1991 | Wolf et al. . | |

*Primary Examiner*—E. Rollins Cross
*Assistant Examiner*—M. Macy
*Attorney, Agent, or Firm*—Walter Ottesen

[57] ABSTRACT

The invention relates to a work apparatus such as a motor-driven chain saw having an internal combustion engine equipped with an electrical ignition system. Combustion air is supplied via an intake channel and fuel is supplied via a carburetor. The intake channel is provided with a throttle flap and the carburetor with a choke flap. The choke flap is displaceable into a start position by means of an actuating element and a start linkage. In this position, the throttle flap is latched in a pregiven open position. The actuating member for the choke flap is mounted in the forward end portion of a handle attached to the housing and extending in the longitudinal direction thereof. In addition, an operator-actuated lever is configured so as to project outwardly beyond the housing of the handle. Because of this arrangement, the latching between the throttle flap and the choke flap is obtained in a simple manner by latching of the throttle lever journalled in the handle with a switching shaft.

10 Claims, 9 Drawing Sheets

PORTABLE HANDHELD WORK APPARATUS

FIELD OF THE INVENTION

The invention relates to a portable handheld work apparatus such as a motor-driven chain saw having an internal combustion engine equipped with an electrical ignition system. Combustion air is supplied via an intake channel and fuel is supplied via a carburetor. The intake channel is provided with a throttle flap and the carburetor with a choke flap. The choke flap is displaceable into a start position by means of an actuating element and a start linkage. In this position, the throttle flap is latched in a pregiven open position.

BACKGROUND OF THE INVENTION

U.S. Pat. No. 4,079,708 is incorporated herein by reference and discloses a motor-driven chain saw having a handle disposed in the longitudinal direction of the housing. In motor-driven chain saws of this kind, a choke flap and, if required, the throttle flap are spring-loaded and positioned in pregiven start positions for starting the engine (warm start, cold start). For this purpose, a starter device is provided which is actuated via an operator-actuated lever. The starter device is mounted in the housing of the chain saw.

U.S. Pat. No. 5,018,492 is also incorporated herein by reference and discloses a motor-driven chain saw having a handle for carrying and guiding the chain saw. This handle is mounted on the top side of the housing and arranged in the longitudinal direction thereof and the throttle lever is mounted in this handle. A starter device arranged in the motor housing cannot be actuated by the thumb of the hand of the operator holding the chain saw because of the arrangement of this handle on the top side of the housing. This makes use of the chain saw by the operator difficult.

SUMMARY OF THE INVENTION

It is an object of the invention to provide a portable handheld work apparatus which is improved so that the starter device is easier to use by an operator.

The handheld portable work apparatus of the invention is a work apparatus such as a motor-driven chain saw or the like and includes: a motor housing defining a longitudinal axis; an internal combustion engine mounted in the housing and having an electrical ignition system and an air intake channel for supplying combustion air to the engine; fuel-metering means for supplying fuel to the engine; the fuel-metering means having a starter element movably mounted between a first position for increasing the quantity of fuel metered to the engine during start and a second position wherein the starter element is not effective for influencing the fuel metered to the engine; a handle mounted on the motor housing so as to extend in the direction of the axis and the handle having a forward end portion; the fuel-metering means including a throttle flap movably mounted in the air-intake channel; a throttle trigger pivotally mounted in the handle; throttle linkage means for connecting the throttle trigger to the throttle flap; an actuating element rotatably journalled in the forward end portion of the handle and being rotatable between first and second positions corresponding to the first and second positions of the starter element; starter linkage means for connecting the actuating element to the starter element for transmitting the movement of the actuating element to the starter element; latching means for latching the throttle flap into a pregiven open position when the actuating element is in the first position; the latching means including a first latch element rotatable with the actuating element and a second latch element disposed on the throttle trigger for engaging the first latch element when the actuating element is in the first position; operator-actuated lever means rotatably journalled in the forward end portion of the handle and being operatively connected to the first latch element and the actuating element for moving the first latch element and the actuating element; and, the throttle trigger being a lever pivotally movable for moving the second latch element away from the first latch element thereby disengaging the latching means.

The choke flap is spring loaded so as to resiliently bias this flap into its open position and the throttle flap is spring loaded so as to bias the same into its idle position as is well known and described in U.S. Pat. No. 4,079,708 incorporated herein by reference.

According to a feature of the invention, the actuating member for the starter element is journalled in the forward end portion of the handle and is displaced by means of an operator-actuated lever projecting outwardly beyond the housing. The starter element can, for example, be a choke flap. The user can therefore adjust the desired position of the starter element (choke flap) with the hand holding the work apparatus without switching the work apparatus off. It is advantageous that the latching device between the actuator member and the throttle trigger is now directly defined by a latching element displaceable with the actuating member preferably via a switching shaft and a counter element arranged on the throttle trigger.

According to a further embodiment of the invention, the starter linkage and the throttle linkage lie approximately parallel in the handle housing toward the rearward portion thereof and are connected to redirect levers journalled in the handle housing. The redirect levers define respective pivot planes which lie at a lateral spacing from each other viewed in the direction of their rotational axes. This configuration makes possible the adaptation of the necessary displacement path of the throttle flap and the starter element since the pivot movements of the redirect levers can overlap each other because of the different pivot planes. With a crossing of the starter linkage and the throttle linkage in their paths to the redirect levers, the most advantageous attaching points for achieving the desired mechanical transmission can be utilized so that a carburetor mounted in the rearward portion of the handle can be operated with functional reliability.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
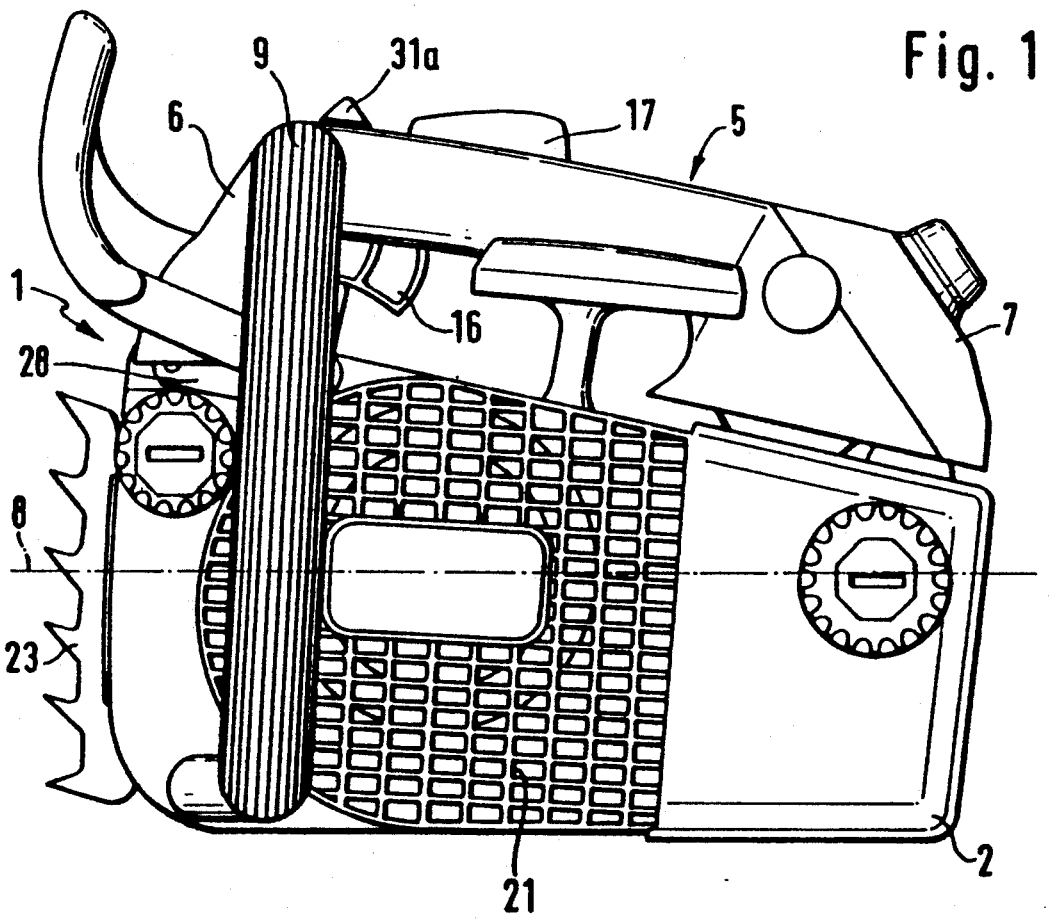
FIG. 1 is a side elevation view of a motor-driven chain saw having a handle arranged in the longitudinal direction of the chain saw on the top side of the housing thereof.

The work apparatus shown in FIG. 1 is a motor-driven chain saw 1 which is referred to as a top-handle chain saw because of its configuration. An internal combustion engine is mounted in a housing 2 for driving the work tool (not shown). For a chain saw, this work tool comprises a guide bar and a saw chain running about the periphery of the guide bar. This work tool projects outwardly in the direction of the longitudinal axis 8 of the chain saw 1 from the forward end face thereof. A toothed stop 23 is mounted on the forward end face for holding the chain saw steady against wood during use.

The longitudinal side of the motor-driven chain saw 1 shown is covered by an air-inlet grid 21 and includes a hand starter. The sprocket wheel cover is mounted on the other longitudinal side of the chain saw and the guide bar is tightly clamped to the housing with this sprocket wheel cover.

The motor-driven chain saw includes a handle 5 suitable for carrying and guiding the chain saw with one hand. The handle 5 is mounted on the top side of the housing 2 and is aligned in the direction of the longitudinal axis 8 of the chain saw. The handle has a forward end portion 6 and is connected to the apparatus housing at this forward portion via antivibration elements 28. The rearward end portion 7 is attached to the housing 2 in the same manner.

A side handle 9 is connected at an angle to handle 5 at the forward end portion 6. The handle 9 extends over the side surface of the housing having the air-inlet grid 21 to the lower edge of the housing and is fixed there via an antivibration element.

The rearward end portion 7 of the handle 5 is configured to widen transversely to the longitudinal axis 8 and defines a mounting space 4 (FIGS. 2 and 3) wherein a metering device for fuel is mounted and which is a carburetor 3 in the embodiment shown.

The throttle flap is mounted in the intake channel of the carburetor 3 and is pivotally journalled on a shaft 11. A throttle lever 12 is seated on one end of the shaft 11 and is actuated by a throttle trigger 16 via the following: a rearward throttle linkage 13, a redirect lever 14 (FIG. 3) and a forward throttle linkage 15. On the side of the handle 5 facing toward the motor housing 2, the throttle trigger 16 projects outwardly from the handle housing and is pivotally journalled on both sides thereof in the forward end portion 6 by a bearing pin 16*a*. The throttle trigger 16 extends rearwardly and lies symmetrically to the longitudinal axis 18 (FIG. 2) of the handle 5. On the handle housing side facing away from the motor housing, a throttle trigger latch 17 projects outwardly and lies symmetrically to the longitudinal axis 18 of the handle 5. The throttle trigger latch 17 coacts with the throttle trigger 16. Only after the throttle trigger latch 17 is depressed, can the throttle trigger 16 be pivoted in the sense of opening the throttle flap (supplying fuel).

Figure 3:
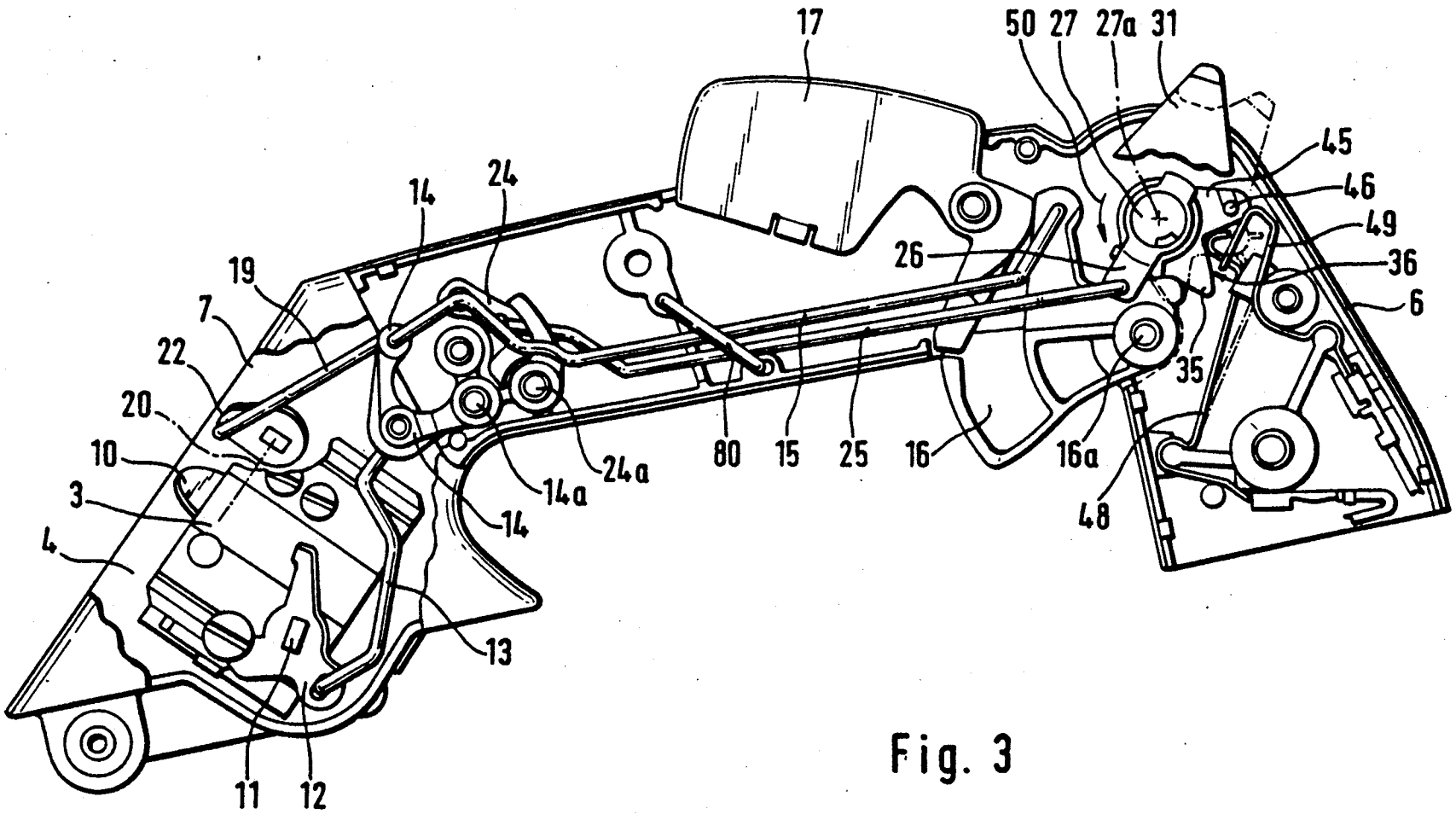
FIG. 3 is a longitudinal section view through the handle of FIG. 2 with a starter device shown in its operating position.
Figure 6:
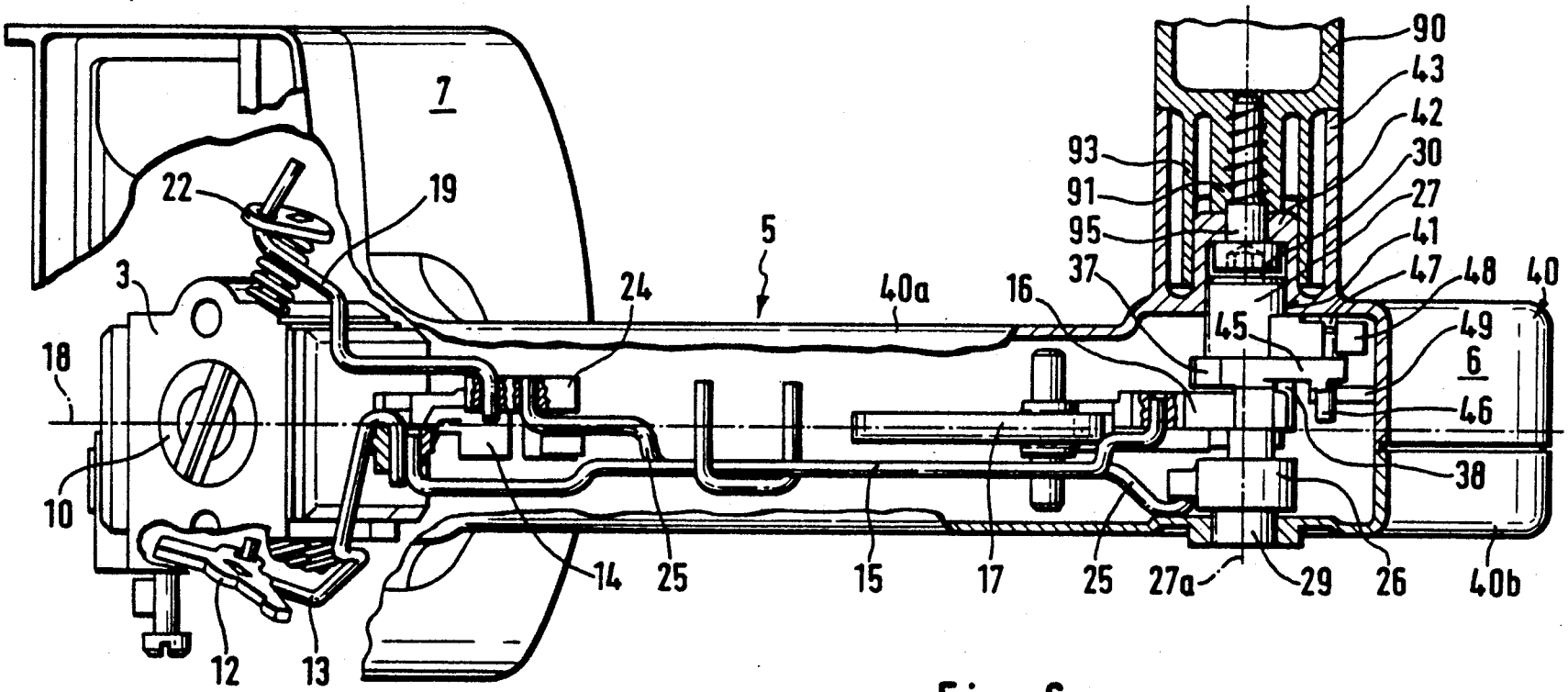
FIG. 6 is a plan view of a section taken through the handle of FIG. 2.
Figure 10:
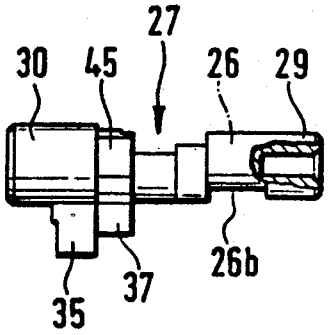
FIG. 10 is a view of the switching shaft of the starter device.

A choke flap 10 is mounted in the in-flow direction of the combustion air forward of the throttle flap. The choke flap 10 acts as a starter element for increasing the supplied quantity of fuel during starting. The choke flap 10 is pivotally journalled by means of a shaft 20 (FIG. 3). The one end of the shaft 20 carries a choke lever 22 which is connected to an actuating member configured as a starter lever 26. The choke lever 22 is connected to the starter lever 26 via the following: a rearward starter linkage 19, a redirect lever 24 and a forward starter linkage 25. The starter lever 26 is journalled on a switching shaft 27 which, in turn, is journalled in the handle housing 40 with its ends (29, 30) defining bearing sections (FIG. 6).

Figure 2:
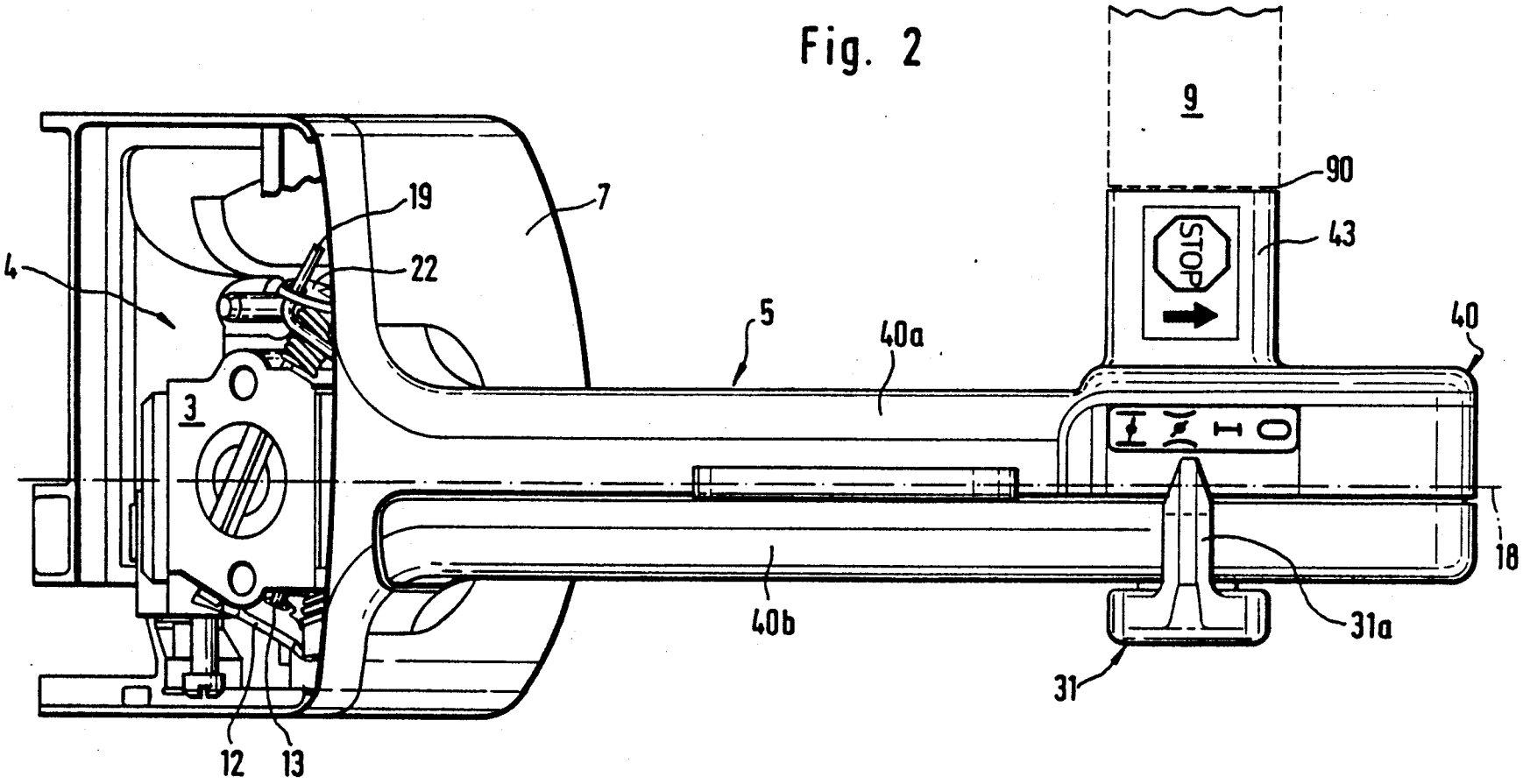
FIG. 2 is a plan view of a handle of a motor-driven chain saw of FIG. 1 with an operator-actuated lever for a starter device being mounted in the forward portion of the handle.
Figure 8:
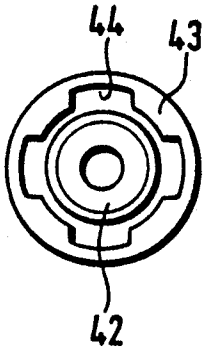
FIG. 8 is an end elevation view of the sleeve-like receptacle for a connecting end of the side handle.

The handle housing includes a base body 40*a* having the configuration of a half shell. The base body 40*a* is closed by a side cover 40*b* (FIGS. 2 and 6). The end 30 of the switching shaft 27 then lies in a bearing opening 41 (FIG. 6) which lies in a projection 42 of the base body 40*a* at the elevation of the connecting end 90 of the side handle 9. The projection 42 has a cylindrical shape and faces toward the side handle 9. The projection 42 lies centrically in a cylindrical sleeve-like receptacle 43 which defines a profile on its inner wall in the axial direction. Preferably, this profile defines slots 44 running in the axial direction (FIG. 8).

Figure 7:
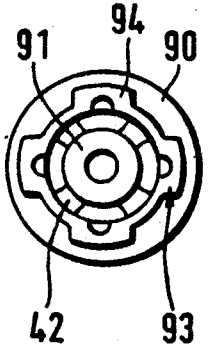
FIG. 7 is an end elevation view of a connecting end of a side handle.

In correspondence to receptacle 43, the connecting end 90 (FIGS. 6 and 7) is provided with a hollow, cylindrical projection 93 on which ribs 94 are formed adapted to the periphery of the slots 44. An attachment cone 91 of the connecting end 90 is disposed at the center of the sleeve-like receptacle 43 for receiving an attachment screw 95 which can be screwed thereinto. The connecting end 90 is inserted with its cylindrical projection 93 into the sleeve-like receptacle 43 of the handle housing 40 and held tight against rotation because of the ribs 94 engaging in the slots 44. With the switching shaft 27 disassembled, the attachment screw 95 is screwed through the bearing opening 41 into the attachment cone 91 and ensures an axial contact engagement without play of the attachment cone 91 on the cylindrical projection 42 as well as on the free end face of the sleeve-like receptacle 43 on an annular shoulder of the connecting end 90. The outer diameter of the sleeve-like receptacle 43 corresponds to the outer diameter of the connecting end 90. After tightening the screw 95, the end 30 of the switching shaft 27 is seated in the cylindrically-shaped projection 42 for journalling.

The switching shaft 27 lies with its rotational axis 27*a* adjacent to the rotational axis (FIG. 3) defined by the bearing pin 16*a* of the throttle trigger 16. The starter lever 26 is journalled on the switching shaft 27 next to the end 29 so as to permit relative movement between starter lever 26 and switching shaft 27. The starter lever 26 is taken along, in the rotational direction 50 (FIG. 3) of the switching shaft 27, from a rest position (FIG. 3) determining the open position of the choke flap 10 into an operating position (FIG. 5) determining the closed position of the choke flap 10. The choke flap 10 is preferably resiliently biased in its at-rest position so that the starter lever 26 is also spring loaded via the starter linkage in its rest position.

A striker cam 37 pivots together with the switching shaft 27 and lies in a plane next to the throttle trigger 16 on the side of the throttle trigger facing toward the end 30 of the switching shaft 27. A latch nose 38 of the throttle trigger 16 projects into the pivot plane of the striker cam 37 and defines the counter element of a latching device which is defined by the latch nose 38 and a latch slot 39 provided in the outer side of the striker cam 37 facing toward the latch nose 38. The latch nose 38 can latch into a latch slot 39 of the striker cam 37 of the switching shaft 27. The latch slot 39 can be seen especially in FIG. 5.

Figure 4:
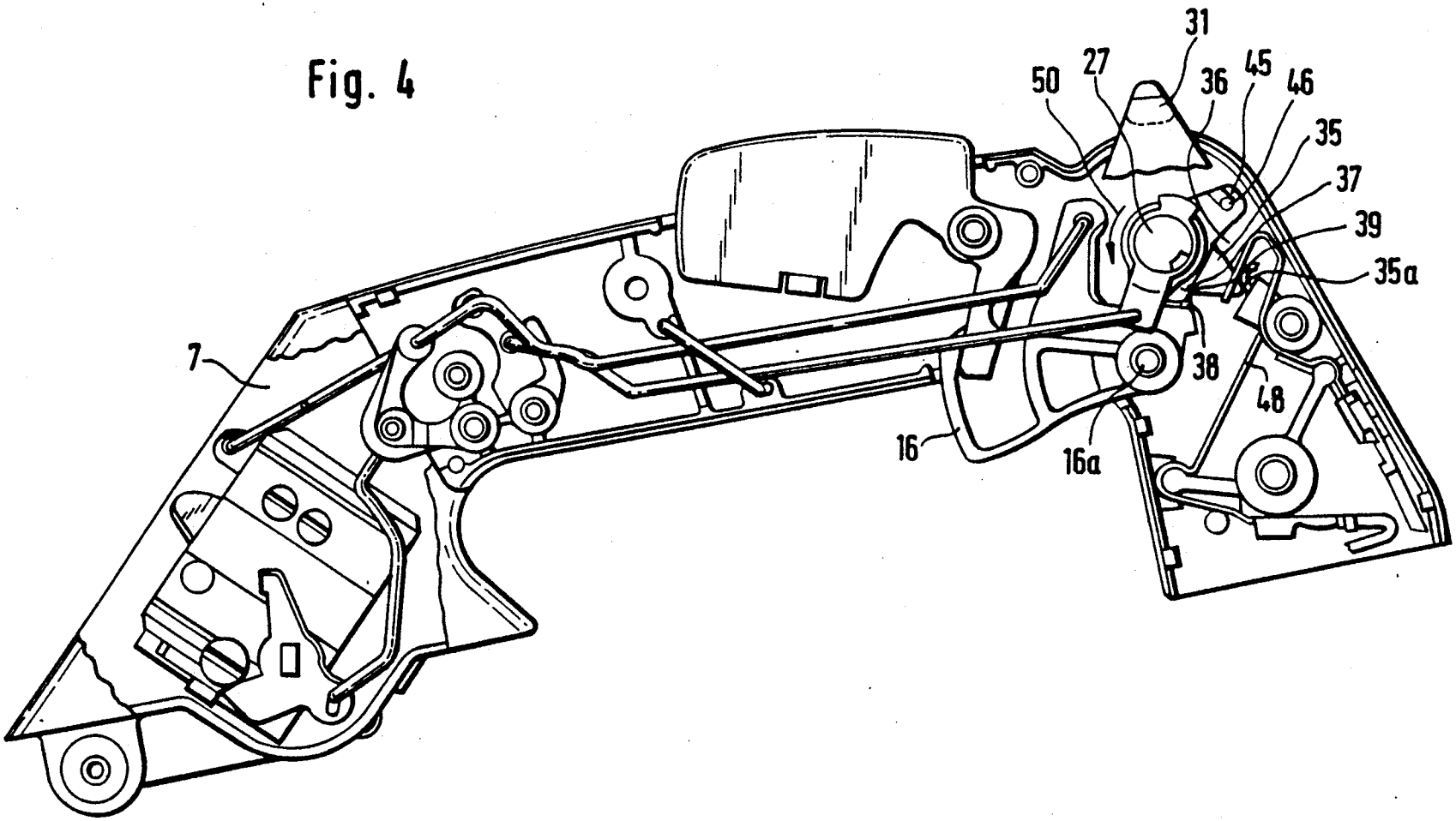
FIG. 4 is a longitudinal section view taken through the handle of FIG. 3 with the starter device in the start position (warm start)

As shown in FIG. 4, a latching between the latch nose 38 and the latch slot 39 is possible when the throttle trigger 16 is partially depressed whereby a start-gas position for the warm start of the engine is set. With this warm-start position, the throttle flap is essentially pivoted into a start position whereas the choke flap 10 lies substantially in an open position or assumes a partially open position.

The throttle flap of the carburetor 3 is actuated via the throttle linkage 13, redirect lever 14 and the forward throttle linkage 15. When the throttle trigger is depressed, it pivots about the pivot pin 16*a* thereby causing the latch nose 38 formed on the throttle trigger to also pivot. The latch nose 38 is shown in FIG. 3 as well as in FIG. 11 as being above the pivot pin 16*a*. This latch nose 38 latches into the latch slot 39 of the striker cam 37. If the throttle trigger 16 is slightly depressed so that the latch nose 38 thereof pivots, the operator-actuated lever 31 can be pivoted into the start position. If the throttle trigger 16 is now released, the latch nose 38 engages the latch slot 39 whereby the throttle trigger 16 is latched in the start position. After the engine is started, the throttle trigger 16 is depressed thereby disengaging the latch (38/39) and the switching shaft 27 is pivoted back into the operating position "I" (identified in FIG. 2) under the action of the return spring.

A cam 35, which determines switching position, is mounted between the striker cam 37 and the end 30 of the switching shaft 27 which is journalled in the bearing opening 41. The cam 35 has a V-shaped axial slot 36. As shown in FIG. 3, the round bent-over end of a leaf spring 48 engages in the slot 36. The leaf spring 48 is fixed in the forward end portion 6 of the handle housing. The leaf spring 48 determines on the one hand the rotational position of the switching shaft 27 shown in FIG. 3 which corresponds to the operating position (the position "I" identified in FIG. 2).

In the start position of FIG. 4, the leaf spring 48 is in contact engagement with a side surface 35*a* in order to spring load the switching shaft 27 in a direction opposite to arrow 50 into its operating position shown in FIG. 3. If the latch 37/38 is released by depressing the throttle trigger 16, then the switching shaft 27 returns to its operating position (FIG. 3) under the action of the spring force of the leaf spring 48 so that the throttle trigger 16 assumes its idle position when this trigger is released.

A switching arm 45 is mounted for rotation in the plane of the striker cam 37. A contact pin 46 is disposed in the free end of the switching arm 45 perpendicular to the pivot plane and overlaps on both sides of the switching arm 45. As shown in FIG. 6, the contact pin 46 lies in a U-shaped receptacle 47 of the widened switching arm so that the bent-over free end 48*a* of the leaf spring 48 can enter into the receptacle or receiving opening 47 in a latching manner when there is contact closure with the contact pin. The contact pin 46 is disposed in the U-shaped receptacle on its side facing toward the bearing end 30. In the position shown in FIG. 3 (phantom outline), the other end of the contact pin 46 lies against a contact spring 49 projecting into its pivot region whereby an electrical connection between the leaf spring 48 and the contact spring 49 is established. The closure of this electrical switch can, for example, be utilized to short circuit the electrical ignition system of the engine so that an operation of the work apparatus is not possible in the stop position shown in phantom outline in FIG. 3. The stop position is secured by the latching engagement of the free end of the leaf spring 48. It is advantageous for the cam 35 to strike against a stop fixed to the housing in the opposite rotational direction 50 in order to prevent a further rotation of the switching shaft opposite to the direction of rotation 50.

With a rotational movement, the switching shaft 27 carries out sequentially or simultaneously different functions in different planes. Beginning at the end 30, a switching plane is defined by the cam 35 having the axial slot 36 which determines the particular position of the switching shaft. The striker cam 37 is mounted next to the switching plane and determines a pregiven pivot position of the throttle trigger 16 and therefore is defined as the starter plane. The switching arm 45 is arranged additionally in the starter plane and determines further a contact plane which can be seen as lying between the switching plane and the starter plane.

Figure 9:
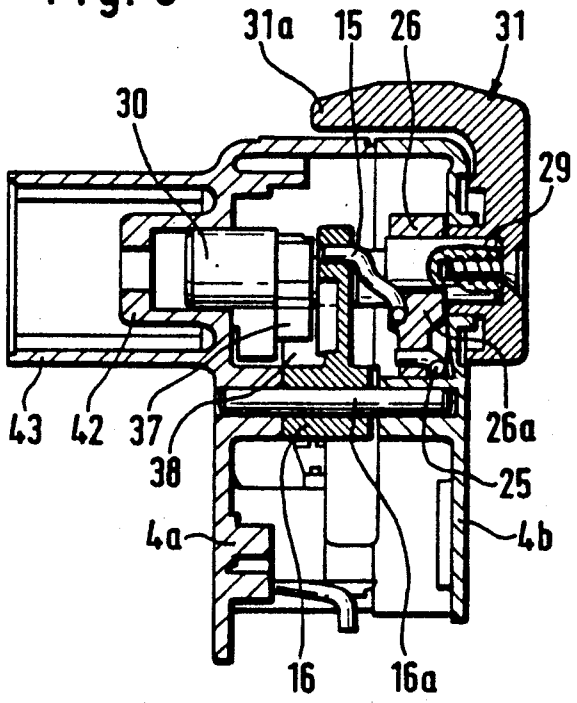
FIG. 9 is a section view taken through the forward portion of the top handle.

As shown in FIG. 9, the starter lever 26 is mounted next to the end 29 of the switching shaft 27 and, for this reason, this plane is characterized as the choke plane. The switching shaft 27 is provided with a deep depression between this choke plane and the starter plane. When the throttle lever 16 is pivoted into the full throttle position, the portion of the throttle lever connected to the throttle linkage can dip into this depression. A cutout of this kind in the switching shaft is advantageous because of the crowded arrangement of the rotation axis of the switching shaft 27 and the bearing pin 16*a* of the throttle trigger 16 as well as the desired large pivot paths.

The end 29 of the switching shaft 27 is configured in the embodiments of FIGS. 1 to 10 to project laterally from the handle cover 40*b*. An operator-actuated lever 31 is fixedly attached to this end 29 and has an actuating end 31*a* extending transversely to the longitudinal center axis 18 of the handle 5. As shown in FIG. 2, a pictograph is associated with each of the particular positions of the operator-actuated lever 31 with the actuable end 31*a* pointing to a pictograph in correspondence to its position.

Figure 9A:
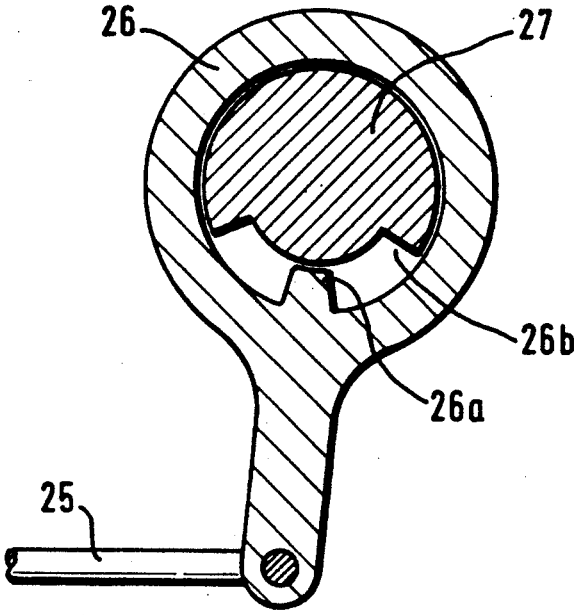
FIG. 9A is an enlarged section view taken through the switching shaft where the starter lever is mounted.

In the stop position, the operator-actuated lever 31 is set at "O" for which the lever 31 is pivoted forwardly opposite to the rotational direction 50 shown in FIG. 3. In this position, the contact pin 46 closes the electrical connection between the leaf spring 48 and the contact spring 49 whereby the ignition is short circuited. To prevent the starter lever 26 from being taken along with a rotational movement out of the operating position (FIG. 3) in a direction opposite to arrow 50, the shaft 27 is configured so as to be freely rotatable relative to the starter lever 26 in the direction toward the stop position and, in the opposite direction beginning with the warm start position, the starter lever is taken along by means of a stop 26*a* formed thereon. As shown in FIGS. 9 and 9*a*, the stop 26*a* is arranged to extend into a cutout 26*b* (see also FIG. 10) of the switching shaft 27 and extends in the peripheral direction over a width which corresponds to the actuating path of the operator-actuated lever 31 from its warm start position (FIG. 3) into its stop position shown in phantom outline.

The rotation of the switching shaft 27 out of the stop position "O" past the operating position "I" to the warm start position (FIG. 2) must not lead to a movement of the choke flap 10 since the choke flap is intended to be effective only during cold start. The choke flap 10 is connected to the starter lever 26 via the linkage (19, 24, 25) with the lever 26 being mounted on the switching shaft 27 and the relative movement referred to above between the switching shaft 27 and the lever 26 must be provided. This relative movement makes possible a rotation of the switching shaft 27 from the stop position "O" past the operating position "I" to the position "warm start". For this reason, the lever 26 is pivotally mounted on the switching shaft 27. This is achieved in that the section of the switching shaft 27 supporting the lever 26 is provided with the cutout 26*b* as described above. This cutout 26*b* (FIGS. 9A and 10) extends in the peripheral direction and corresponds to the displacement path of the switching shaft 27 from the position "O" to the position "warm start". The inner radial stop 26*a* of the lever 26 projects into the receiving region of the cutout 26*b* with the stop 26*a* being substantially less in peripheral width than the width of the cutout 26*b* as shown in FIG. 9A.

If the operator-actuated lever 31 is pivoted in the rotational direction 50 from the stop position (shown in phantom outline in FIG. 3) first only the contact pin 46 is lifted from the springs 48 and 49 so that the ignition is electrically switched on. In order to now start the engine, the carburetor must be set to the start position and, for this purpose, the throttle trigger 16 is depressed so that the striker cam 37 can pivot into the pivot path of the throttle trigger latch nose 38. Without depressing the throttle trigger, the latch nose 38 of the throttle trigger 16 lies forward of the striker cam 37 to block the latter so that a displacement of the operator-actuated lever 31 out of the operating position into the start position is not possible. This assures that a closure of the choke flap is precluded when the engine is running at idle.

Figure 5:
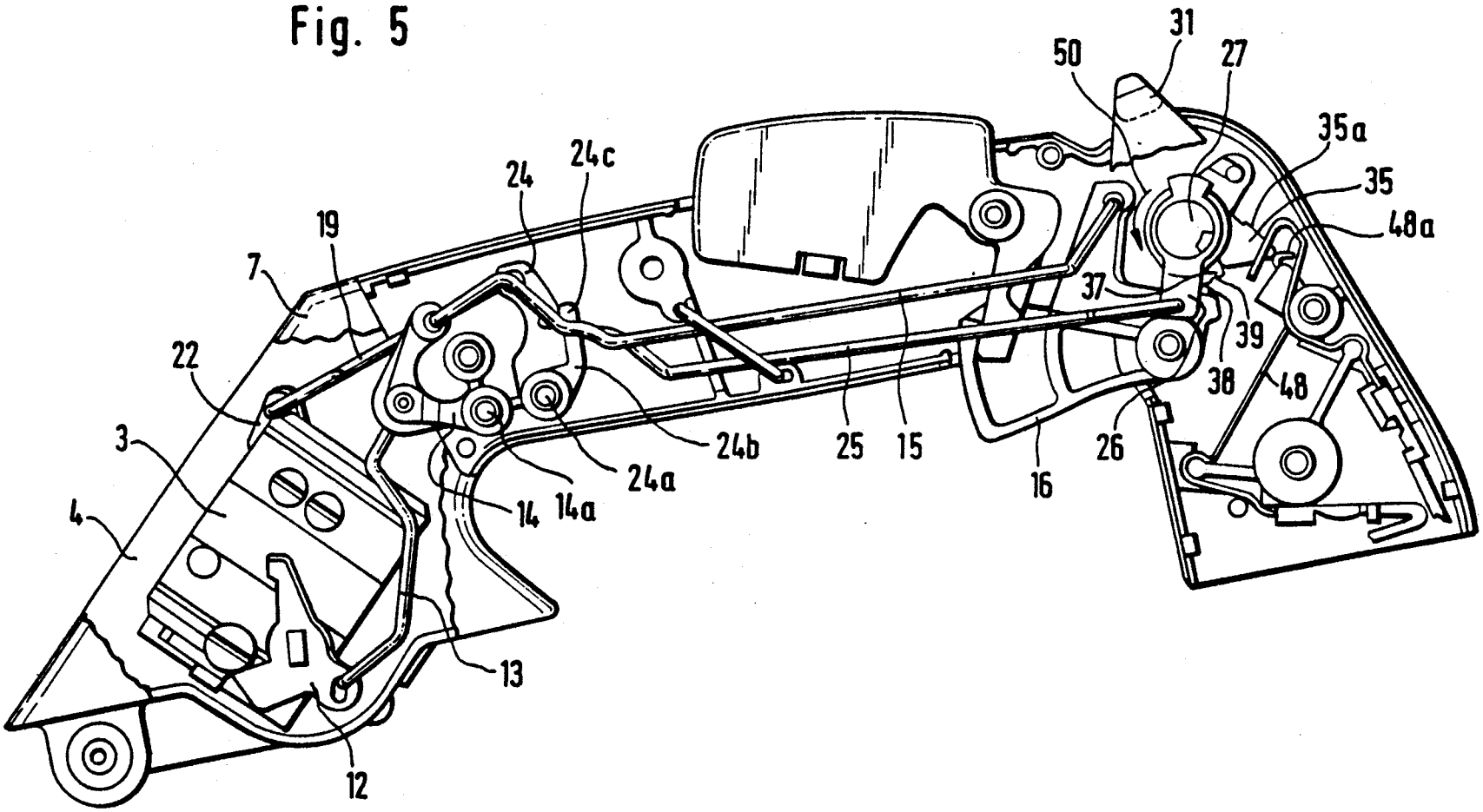
FIG. 5 is a longitudinal section view through a handle of the kind shown in FIG. 3 equipped with the starter device in choke position (cold start)

After depressing the throttle trigger 16 for a cold start of the engine, the operator-actuated lever 31 is pivoted to its most rearward position (cold-start position, FIG. 5). The switching lever 27 then takes the starter lever 26 along in the rotational direction 50 so that the rearward starter linkage 19 is moved via the forward starter linkage 25 and the redirect lever 24 and the choke flap is completely closed by means of the choke lever 22. As shown in FIG. 5, the free end 48*a* of the leaf spring 48 has in this position slid off the surface 35*a* of the cam 35 so that the leaf spring no longer applies any spring force to the switching shaft 27 opposite the rotational direction 50. Instead, the free end 48*a* now lies on the surface opposite to the surface 35*a* and applies a force in the rotational direction 50 whereby the cold start position of the starter device is secured in its position.

The striker cam 37 is pivoted into the pivot path of the latch nose 38 and holds the throttle trigger 16 in a partially-depressed position so that the throttle flap displaces the throttle lever 12 via the forward throttle linkage 15, the redirect lever 14 and the rearward throttle linkage 13 and so that the throttle flap is held in a start position necessary for the start.

After the engine has started, the operator-actuated lever 31 must be displaced opposite to the arrow direction 50 past the warm-start position into the operating position. This affords the advantage that for a closed choke, the operator can increase the engine speed by depressing the throttle lever in order to obtain a rapid warming of the engine. However, it can also be advantageous to provide an automatic return positioning of the starter device into the operating position when depressing the throttle lever.

If the engine is to be started while warm, then the operator-actuated lever 31 is pivoted into the start position shown in FIG. 4 (warm start) wherein the latch slot 39 of the striker cam 37 latches with the latch nose 38 of the throttle lever 16. After start of the engine, the latch is released by actuating the throttle trigger 16 so that the starter device is returned to the operating position under the action of the leaf spring 48 which, at the same time, acts as a contact spring.

As shown above, the forward throttle linkage 15 and the forward choke linkage 25 extend essentially parallelly to each other in the handle toward the rear where they are articulately connected to the redirect levers 14 and 24, respectively, in the vicinity of the rearward end portion 7. The throttle linkage 15 and the choke linkage 25 mutually cross on their paths to the redirect levers in a region just ahead of where they are articulately connected to the levers. A safety bracket 80 which engages around the linkages is provided in order to secure the position of the throttle linkage 15 and the choke linkage 25. This bracket is releasably inserted into the base body 4*a* of the handle (FIG. 3).

The rotational axes 14*a* and 24*a* of redirect levers 14 and 24, respectively, lie adjacent to the end portion 7 of the handle in the center handle portion on the side facing toward the housing. As shown in FIG. 6, the pivot planes of the levers 14 and 24 are disposed with a slight spacing parallel to each other so that the two levers cannot interfere with each other in their movements. The pivot plane of the redirect lever 24 then lies on the one side and the pivot plane of the redirect lever 14 lies on the other side of the longitudinal center axis 18 of the handle 5.

The redirect lever 24 of the starter linkage 19/25 is essentially an elongated lever which is engaged at its center by the starter linkage 25; whereas, the rearward starter linkage 19 engages at a free end lying opposite to the bearing axis 24*a*. The bearing end of the throttle lever 24 is configured so as to be bifurcated as shown especially in FIG. 6. The one end 24*c* of the fork 24*b* extends to beyond the connecting end of the center choke linkage 25. In this way, it is ensured that the axial end of the linkage 25 inserted on the redirect lever 24 cannot slip out of the redirect lever 24 because of movements.

The redirect lever 14 of the throttle linkage is configured to be approximately V-shaped or L-shaped with the one free end of a leg being journalled in the handle housing 40 about the rotational axis 14*a*. At the other free end, the center throttle linkage 15 is articulately connected whereas the rearward throttle linkage 13 engages at the connecting point of the two legs on the redirect lever 14. The V-shaped redirect lever 14 lies with its opening facing away from the end portion 7 of the handle with the redirect lever 24 of the starter linkage lying forward of the opening in the adjacent pivot plane. Both levers pivot in the clockwise direction for closing the choke flap and for opening the throttle flap.

In the embodiment shown, the carburetor 3 is mounted in the mounting space 4 provided in the handle 5. The rearward throttle linkage 13 and the rearward start linkage 19 lead to the mounting space 4. The rearward throttle linkage 13 or start linkage 19 can however extend through an opening in the motor housing in order to there control a carburetor, an injection pump or the like.

It can be advantageous not to fix the operator-actuated lever 31 laterally to the switching shaft 27; instead, to configure the same as a pin inserted radially into a receptacle of the switching shaft. The pin can project radially out of the top side of the handle housing 40.

Figure 12:
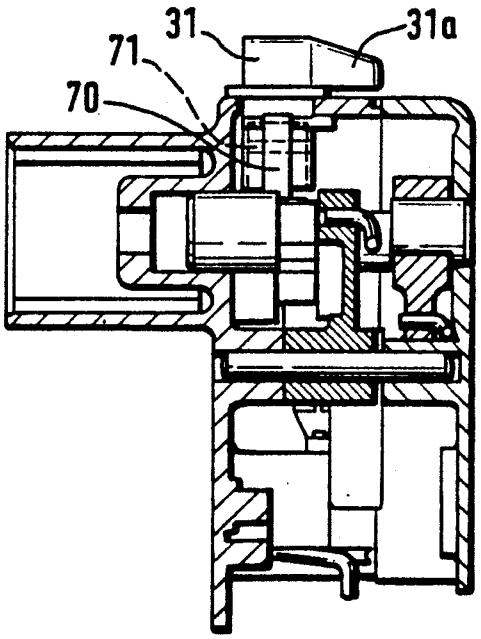
Figure 11:
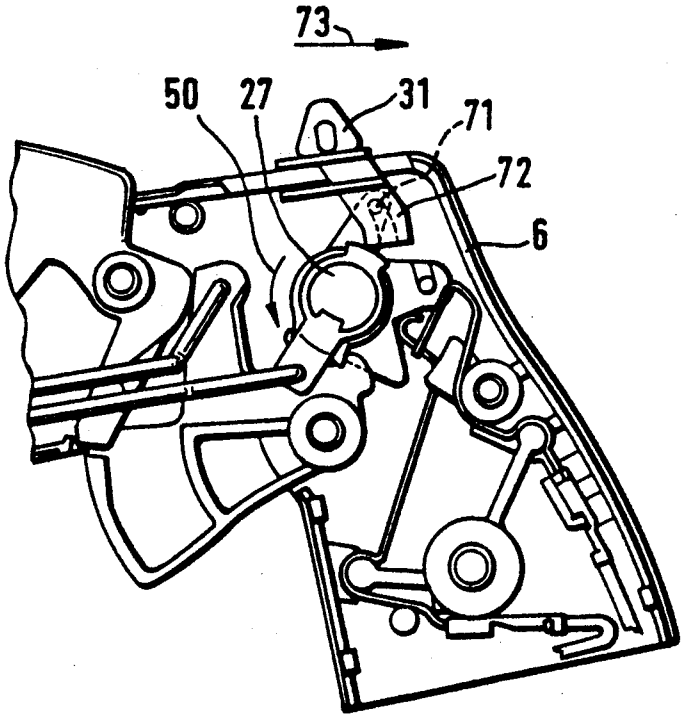
FIG. 11 is a longitudinal section view taken through the forward end portion of the handle having an operator-actuated lever extending through the housing; and, FIG. 12 is a section view taken through the forward portion of the handle having an operator-actuated lever of FIG. 11.

In another embodiment of the invention, the operator-actuable lever 31 is configured as a slider in the forward end portion 6 of the handle 5 (FIGS. 11 and 12). To convert the slider movement carried out in the longitudinal direction of the handle into a rotational movement of the switching shaft 27, the shaft 27 has a coupling arm 70 which lies with a guide pin 71 in an appendage 72 of the operator-actuable lever 31 (slider). The longitudinal movement of the operator-actuable lever 31 in the direction of arrow 73 is converted by the appendage into a rotational movement of the switching shaft 27 in or opposite to the direction of arrow 50. The configuration of the starter device corresponds otherwise to that shown in FIGS. 1 to 10 and described above.

All pivotable parts such as throttle lever 16, throttle lever latch 17, switching shaft 27, redirect lever 14 and redirect lever 24 are journalled at both ends of the longitudinal center axis 18 of the handle 5 in the handle housing 40. The bearings on one side of the longitudinal center axis 8 all lie in the base body 40*a* of the handle and the bearings on the other side of this axis all lie in the handle cover 40*b*.

It is understood that the foregoing description is that of the preferred embodiments of the invention and that various changes and modifications may be made thereto without departing from the spirit and scope of the invention as defined in the appended claims.

What is claimed is:

1. A handheld portable work apparatus such as a motor-driven chain saw, the work apparatus comprising:

a motor housing defining a longitudinal axis;

an internal combustion engine mounted in said housing and having an electrical ignition system and an air intake channel for supplying combustion air to the engine;

fuel-metering means for supplying fuel to said engine;

said fuel-metering means having a starter element movably mounted between a first position for increasing the quantity of fuel metered to the engine during start and a second position wherein the starter element is not effective for influencing the fuel metered to the engine;

a handle mounted on said motor housing so as to extend in the direction of said axis and said handle having a forward end portion;

said fuel-metering means including a throttle flap movably mounted in said air-intake channel;

a throttle trigger pivotally mounted in said handle;

throttle linkage means for connecting said throttle trigger to said throttle flap:

an actuating element rotatably journalled in said forward end portion of said handle and being rotatable between first and second positions corresponding to said first and second positions of said starter element;

starter linkage means for connecting said actuating element to said starter element for transmitting the movement of said actuating element to said starter element;

latching means for latching said throttle flap into a pregiven open position when said actuating element is in said first position;

said latching means including a first latch element rotatable with said actuating element and a second latch element disposed on said throttle trigger for engaging said first latch element when said actuating element is in said first position;

operator-actuated lever means rotatably journalled in said forward end portion of said handle and being operatively connected to said first latch element and said actuating element for moving said first latch element and said actuating element; and, said throttle trigger being a lever pivotally movable for moving said second latch element away from said first latch element thereby disengaging said latching means.

2. The handheld portable work apparatus of claim 1, wherein said handle defines a longitudinal handle axis; said operator-actuated lever means including a switching shaft pivotally mounted in said forward end portion so as to extend transversely to the direction of said handle axis; and, an extension fixedly connected to said switching shaft and disposed outside of said forward end portion to facilitate movement thereof by the operator so as to permit said switching shaft to rotate.

3. The handheld portable work apparatus of claim 2, further comprising contacts for opening and shorting the ignition system and said switching shaft supporting a contact pin for opening said contacts when said switching shaft is in a first rotational position and for closing said contacts when said switching shaft is in a second rotational position defining a stop position; and, said actuating element being mounted on said switching shaft so as to enable said switching shaft to rotate relative to said actuating element when said shaft is rotated into said second rotational position; and, take-along means at the interface of said switching shaft and said actuating element for taking said actuating element along when said switching shaft rotates past said first position in a rotational direction away from said second position.

4. The handheld portable work apparatus of claim 3, said second latch element being a latch nose formed on said throttle lever and said first latch element being a striker cam formed on said switching shaft, said striker cam including a latch slot formed therein for holding said latch nose therein when said switching shaft is in a first rotational position defining a warm start position;

and, said striker cam including a cam surface for contact engaging said latch nose when said switching shaft is in a second rotational position defining a cold start position.

5. The handheld portable work apparatus of claim 4, said handle defining a handle housing; said switching shaft having respective journalling ends rotatably journalled in said handle housing; said first latch element being formed on said switching shaft in a first plane next to one of said journalling ends and said actuating element being rotatably journalled on said switching shaft next to the other one of said journalling ends; said switching shaft having a lever in said first plane carrying said contact pin extending perpendicularly to the direction of rotation of said switching shaft; said contacts being respective electrical contact springs; one of said springs being mounted in said housing so as to resiliently bias said switching shaft from a rotational position corresponding to a warm start into a rotational position corresponding to an operating position; said one spring having a free end and said contact pin having a receptacle formed therein for receiving said free end when said shaft is in said second rotational position defining said stop position.

6. The handheld portable work apparatus of claim 5, said other journalling end extending out of said handle housing and said extension being connected to said other end; and, said extension including a bent over end portion disposed in spaced relationship to the top surface of said handle housing and extending transversely to the direction of said axis.

7. The handheld portable work apparatus of claim 6, said handle housing including said forward end portion attached to said motor housing and also including a rearward end portion likewise attached to said motor housing; said handle housing also including an elongated portion extending between said end portions; said throttle linkage means including: a throttle flap redirect lever mounted in said rearward end portion and operatively connected to said throttle flap for pivoting said throttle flap; and, throttle linkage rod means interconnecting said throttle redirect lever and said throttle trigger and being disposed in said elongated portion of said handle housing; said starter linkage means including: a starter element redirect lever mounted in said rearward end portion and operatively connected to said starter element for pivoting said starter element; and, starter element linkage rod means interconnecting said starter element redirect lever and said actuating element and being disposed in said elongated portion of said handle housing so as to be approximately parallel to said throttle linkage rod means; and, said redirect levers defining respective pivot shafts defining respective pivot planes laterally separated from each other when viewed in the axial direction of said pivot shafts.

8. The handheld portable work apparatus of claim 7, said starter element redirect lever being a bell crank lever having first and second arms joined at a common connecting joint; the free end of said first arm being pivotally mounted in said handle housing and the free end of said second arm and said common connecting point being connected to said starter element linkage rod means.

9. The handheld portable work apparatus of claim 5, said handle being a top handle and said work apparatus further comprising a side handle having a first end mounted on said motor housing and a second end mounted on said top handle; said top handle having a sleeve-like receptacle formed thereon for receiving said second end of said side handle; said sleeve-like receptacle being a sleeve-like projection defining an axis; said projection and said second end conjointly defining a profiled interface; and, said profiled interface defining profiles extending in the direction of said axis of said projection thereby preventing said second end from rotating relative to said sleeve-like projection.

10. The handheld portable work apparatus of claim 9, said handle housing defining a journalling opening formed therein for receiving said one journalling end of said switching shaft; said sleeve-like projection including a wall therein near the end of said journalling opening; said second end of said side handle having an attachment portion extending into said sleeve-like projection so as to be in contact engagement with said wall; and, a screw extending through said wall and into said attachment portion to firmly hold said second end in said sleeve-like projection.

* * * * *